United States Patent [19]

Reimann et al.

[11] Patent Number: 4,570,456

[45] Date of Patent: Feb. 18, 1986

[54] DIRECT FIRED HEAT EXCHANGER

[75] Inventors: Robert C. Reimann, Lafayette, N.Y.; Richard A. Root, Spokane, Wash.

[73] Assignee: The United States of America as represented by the United States Department of Energy, Washington, D.C.

[21] Appl. No.: 670,098

[22] Filed: Nov. 13, 1984

[51] Int. Cl.[4] ..... F25B 15/00

[52] U.S. Cl. ..... 62/476; 62/497

[58] Field of Search ..... 68/476, 497

[56] References Cited

U.S. PATENT DOCUMENTS

| | | | |
|---|---|---|---|
| 2,753,954 | 7/1956 | Tinker | 62/497 |
| 3,316,727 | 5/1967 | Bourne | 62/476 X |
| 3,452,551 | 7/1969 | Aronson | 62/476 X |

*Primary Examiner*—Lloyd L. King

*Attorney, Agent, or Firm*—Robert H. Kelly

[57] ABSTRACT

A gas-to-liquid heat exchanger system which transfers heat from a gas, generally the combustion gas of a direct-fired generator of an absorption machine, to a liquid, generally an absorbent solution. The heat exchanger system is in a counterflow fluid arrangement which creates a more efficient heat transfer.

4 Claims, 2 Drawing Figures

DIRECT FIRED HEAT EXCHANGER

STATEMENT AS TO RIGHTS TO INVENTIONS MADE UNDER FEDERALLY SPONSORED RESEARCH AND DEVELOPMENT

The U.S. Government has rights in this invention pursuant to contract No. W-7405-ENG-26 awarded by the U.S. Department of Energy.

BACKGROUND OF THE INVENTION

This invention relates generally to heat exchangers and is particularly related to gas-to-liquid heat exchanger apparatus. More specifically, the present invention relates to a gas-to-liquid heat exchanger system which transfers heat from the combustion gas of a direct-fired generator of an absorption machine to a liquid.

In absorption refrigeration systems, it is conventional to supply external heat, usually in the form of steam or direct-fired combustion gas, to the generator in order to heat a weak absorbent solution, typically a lithium bromide solution, and thereby increase the concentration of the absorbent. Generally, the lower portion of the generator vessel if filled with solution with combustion tubes extending therethrough. The operation of a direct-fired absorption refrigeration system is known in the art and will not be described herein in detail. An example of an absorption system is found in U.S. Pat. 3,316,727 and is incorporated by reference herein.

Although the present invention can be used in association with a wide range of devices having heat transfer capabilities, it is particularly well suited in conjunction with a direct gas-fired absorption machine.

The herein described heat exchanger employs individual in-shot burners and tubes arranged in a counterflow manner to effect more efficient heat transfer which raises the overall efficiency potential of the absorption machine in which it is installed.

SUMMARY OF THE INVENTION

This invention is directed to a heat exchanger for a direct-fired generator for use in a gas-fired absorption machine.

In a preferred embodiment, combustion gas and air are introduced through in-shot burners in the burner assembly and are combusted in the combustion tubes. The combustion tubes include two passes, an upper pass in an upper solution tray, and a lower pass in a lower solution tray. Both trays include a plurality of baffles which provide a serpentine path for the solution admitted to the upper tray of the generator. The solution is admitted to the upper tray near the discharge end of the combustion tubes and is discharged nearest the initial firing end of the combustion tubes in the lower tray. Accordingly, the flow of the fluids, the combustion gas and solution, is such that counterflow heat transfer is achieved with the hottest combustion gas entering the heat exchanger in proximity with the hottest leaving solution and the coolest combustion gas leaving the heat exchanger in proximity with the coolest entering solution.

It is an object of the present invention to improve the efficiency of an absorption machine by utilizing the submerged bundle counterflow heat exchanger in the generator of the absorption machine.

It is a further object of the present invention to arrange the combustion tubes of a direct-fired generator in at least two solution trays to avoid submergence losses due to pressure gradient of the solution at the lower tubes of the generator.

It is another object of the present invention to arrange the combustion tubes of a direct-fired generator in a counterflow manner to effect more efficient heat transfer.

It is still a further object of the present invention to provide a heat exchanger which is economical to manufacture, simple in construction, and more efficient than the prior art heat exchangers.

The various features of novelty which characterize the invention are pointed out with particularity in the claims annexed to and forming part of this specification. For a better understanding of the invention, its operating advantages and specific objects attained by its use, reference should be had to the accompanying drawings and descriptive matter in which there is illustrated and described a preferred embodiment of the invention.

BRIEF DESCRIPTION OF THE DRAWINGS

In the accompanying drawings, forming a part of this specification, and in which reference numerals shown in the drawings designate like or corresponding parts throughout the same.

DESCRIPTION OF THE PREFERRED EMBODIMENT

Figure 1:
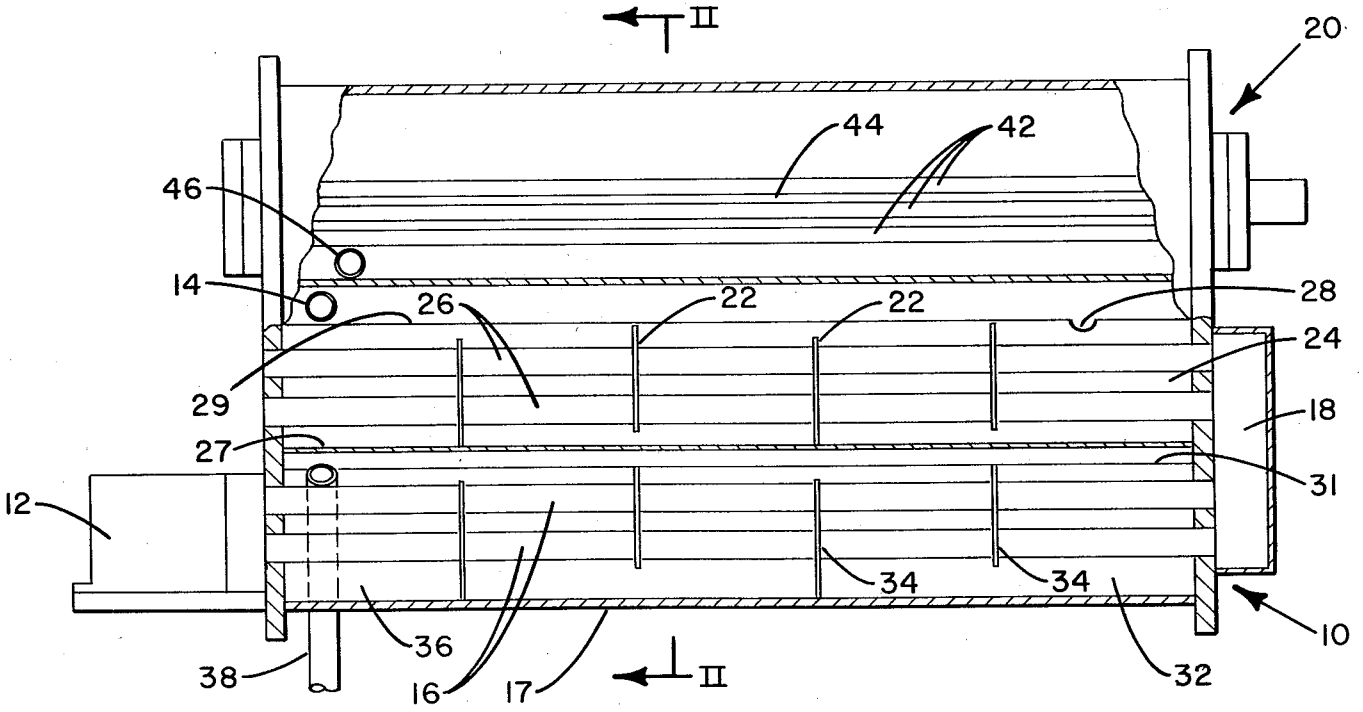
FIG. 1 is an elevational view, partly broken away and partly in section, of a direct-fired generator of an absorption machine utilizing the present invention.
Figure 2:
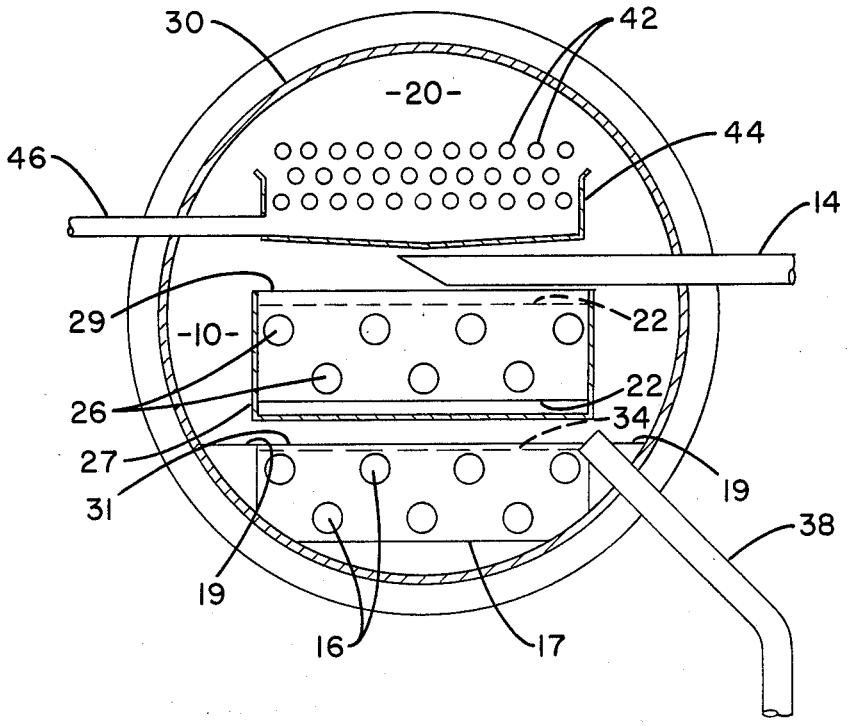
FIG. 2 is an elevational view of the generator taken along the line II—II of FIG. 1.

FIGS. 1 and 2 illustrate a direct-fired generator for an absorption refrigeration system according to the present invention, which, for example, employes water as a refrigerant and lithium bromide as an absorbent solution. Technically, pure lithium bromide is an absorbent and is not an absorbent solution. However, it is customary to refer to the absorbent in an absorption refrigeration system as being a solution because the absorbent may have refrigerant dissolved therein. Therefore, the term "solution" is used throughout this application to denote pure absorbent and absorbent solution. Also, it should be noted that the term "strong solution" is used herein to denote an absorbent solution which has a high concentration of absorbent, such as pure lithium bromide, while the term "weak solution" is used herein to denote an absorbent solution which has a low concentration of absorbent becsuse it has a substantial quantity of refrigerant dissolved therein. Further, it should be noted that refrigerants, other than water, and absorbents, other than lithium bromide, may be used within the scope of this invention and various modifications may be made to the refrigeration system to accommodate these different refrigerants and absorbents.

The absorption refrigeration system, which the generator 10 forms a part thereof, generally further includes at least one absorber, condenser, evaporator, refrigerant pump, solution pump and solution heat exchanger.

As a suitable source for boiling refrigerant out of the weak solution supplied through generator inlet line 14, generator 10 includes a suitable burner assembly 12 for supplying combustion gas and air, to lower and upper combustion tubes. The ignited mixture of gas and air flows through the lower combustion tubes 16 located within lower solution tray 17 through connecting chamber 18, then flows through upper combustion tubes 26, located in upper solution tray 27 to be finally discharged from the upper combustion tubes to a flue (not shown).

The weak solution supplied to the generator 10 through generator inlet line 14, generally flowing from an absorber through a solution heat exchanger, enters the upper solution tray 27 and flows through said upper solution tray in a generally parallel relation to the upper combustion tubes 26.

The weak solution flows in the upper solution tray, alternately weaving over and under a plurality of baffles 22 until reaching the end baffled section 24. The weak solution entering the upper solution tray is heated by the upper combustion tubes 26 which boils refrigerant out of the weak solution. The refrigerant vapor formed in the upper solution tray passes out of the open top 29 of the solution tray, which is a trough-like tray, into a condenser 20 where it is cooled and condensed. The relatively hotter, stronger solution flowing into end baffle section 24, flows out overflow port 28, and into the adjacent end baffle section 32 of the lower solution tray 17. This stronger overflow solution then flows generally parallel to the lower combustion tubes 16, alternately over and under the lower baffles 34 in a serpentine fashion, to the lower front baffle section 36. In the lower front baffle section 36, the hot, strong concentrated solution overflows the lower solution tray and passes through a discharge passageway 38 into the absorber.

The orientation and flow of the fluids in the combustion tubes and the upper and lower solution trays is such that counterflow is achieved with the hottest combustion gas entering the lower combustion tubes 16 in heat exchange relationship with the hottest leaving concentrated solution flowing out discharge passageway 38 and the coolest combustion gas leaving the upper combustion tubes 26 in heat exchange relationship with the coolest weak solution entering the upper solution tray 27 through generator inlet line 14. Accordingly, this heat exchange method is more effective since it effects counterflow heat exchange flow, avoids submergence losses due to pressure gradients, and reduces solution inventory in the generator by containing it in close proximity to the heat exchange tubes.

The refrigerant vapor formed in the generator flows into the condenser 20, which has a trough like heat exchanger having a plurality of condenser tubes 42 contained within an open trough like shell 44, where this refrigerant vapor is cooled and condensed. The liquid refrigerant condensed in the condenser 20 passes through a refrigerant liquid passage 46 into the evaporator. A fluid medium, such as water, passes through the condenser tubes 42 to condense the liquid refrigerant in the condenser.

Referring to FIG. 2, it may be seen that the generator 10 and condenser 20 sections are included within a single shell 30, but it will be appreciated that other configurations will be satisfactory. The burner assembly supplies an ignited mixture of gas and air into lower combustion tubes 16 to heat weak solution which is supplied to the generator from the absorber through generator inlet line 14. The weak solution is heated in the upper solution tray 27 and lower solution tray 17 to boil off refrigerant vapor and to thereby concentrate the weak solution. Refrigerant rises upwardly to the condenser section 20. The condenser section 20 is conveniently located in the same shell 30 as the generator but may be a separate vessel, and comprises a plurality of heat exchange condenser tubes 42. The refrigerant vapor is condensed to liquid refrigerant in said condenser section. Liquid refrigerant passes from the condenser section 20 through refrigerant liquid passage 46 to the evaporator.

Also, it should be noted that the lower solution tray 17 and upper solution tray 27 are trough like vessels, open at their tops, which permit the weak solution entering generator inlet line 14 to weave over and under the upper baffles 22 in a generally parallel relationship to the upper combustion tubes 26. The weak solution entering the upper solution tray 27 through open top 29 flows to the upper end baffle section 24 and overflows into the lower solution tray 17. The lower solution tray is also an open topped 31 trough like vessel having upper plates 19 connected to the shell 30 to guide the overflow solution into the lower tray. The heated, partially concentrated solution overflowing into the lower solution tray 17 also alternately weaves over and under lower baffles 34 to the lower front baffle section 36. Hot, strong solution flowing into the lower front baffle section 36 then passes out through discharge passageway 38 to the absorber. In this manner, the counterflow fluid arrangement creates a more efficient heat transfer which raises the overall efficiency of the absorption machine.

What is claimed is:

1. Apparatus for supplying heat to an absorption refrigeration system comprising:

an absorption refrigeration system including an absorber, an evaporator, a generator, a condenser, refrigerant, and absorbent solution divisible into a strong solution and a weak solution;

means for passing combustion gas through said generator, said means having an inlet and an outlet;

housing means defining a passageway for the absorbent solution, said housing means including walls and a bottom portion for enclosing said combustion gas supplying means, said passageway guides the flow of the absorbent solution therethrough;

a plurality of spaced apart plates in said housing means transverse to the flow of the absorbent solution, said plates alternately attached to and spaced from said bottom portion to control the flow of the absorbent solution in an undulating motion; and an inlet and outlet means for supplying and removing absorbent solution to and from said housing means, said inlet supplying the absorbent solution juxtapose the outlet passing combustion gas through said generator and said outlet removing the absorbent solution juxtapose the inlet passing combustion gas through said generator.

2. An apparatus for supplying heat to an absorption refrigeration system as set forth in claim 1 wherein said means for passing combustion gas through said generator comprises multiple pass tubes wherein said tubes include a first group of individual combustion tubes, a second group of individual combustion tubes, a connecting group of tubes for connecting each individual tube of the first group to a corresponding individual tube of the second group whereby the combustion gas flowing through the second group of individual combustion tubes flows in the reverse direction of the combustion gas glowing through the first group of individual combustion tubes.

3. An apparatus for supplying heat to an absaorption refrigeration system as set forth in claim 2 wherein said housing means comprises a first passageway for said first group of individual combustion tubes and a second passageway for said second group of individual combustion tubes.

4. An apparatus for supplying heat to an absorption refrigeration system as set forth in claim 3 wherein said first passageway is spaced above said second passageway whereby the absorbent solution enters the first passageway and flows in a direction opposite to the combustion gas flowing through the first group of individual combustion tubes and then enters the second passageway which reverses the flow of the absorbent solution therethrough.

* * * * *

UNITED STATES PATENT AND TRADEMARK OFFICE

CERTIFICATE OF CORRECTION

PATENT NO. : 4,570,456

DATED : February 18, 1986

INVENTOR(S) : ROBERT C. REIMANN, RICHARD A. ROOT

It is certified that error appears in the above-identified patent and that said Letters Patent are hereby corrected as shown below:

In Claim 2, at line 67 of column 4, change "glowing" to --flowing--.

Signed and Sealed this

*Twentieth* Day of *May 1986*

[SEAL]

*Attest:*

DONALD J. QUIGG

*Attesting Officer*

*Commissioner of Patents and Trademarks*